US005778493A

United States Patent [19]

Moretti et al.

[11] Patent Number: 5,778,493

[45] Date of Patent: Jul. 14, 1998

[54] DEVICE AND METHOD FOR AUTOMATICALLY REPLACING THE FEED LAP PACKAGES AND FOR PREPARING AND JOINING THE RELATIVE EDGES IN A COMBING MACHINE

[75] Inventors: Giuseppe Moretti; Gian Mario Baitelli; Giovanni Battista Pasini, all of Palazzolo sull'Oglio, Italy

[73] Assignee: F.LLI Marzoli & C. S.p.A., Bergamo, Italy

[21] Appl. No.: 731,610

[22] Filed: Oct. 16, 1996

[30] Foreign Application Priority Data

Oct. 16, 1995 [IT] Italy ..... MI95A2122

[51] Int. Cl.[6] ..... D01G 19/08

[52] U.S. Cl. ..... 19/115 R

[58] Field of Search ..... 19/0.25, 115 R, 19/215, 229, 115 A, 65 A, 225; 57/281

[56] References Cited

U.S. PATENT DOCUMENTS

| | | | |
|---|---|---|---|
| 5,027,475 | 7/1991 | Mondini et al. | 19/115 R |
| 5,077,865 | 1/1992 | Mondini et al. | 19/115 R |
| 5,303,453 | 4/1994 | Langel et al. | 19/115 R |
| 5,337,455 | 8/1994 | Clement . | |
| 5,337,456 | 8/1994 | Clement | 19/115 R |
| 5,430,917 | 7/1995 | Inagaki et al. | 28/141 |

FOREIGN PATENT DOCUMENTS

| | | |
|---|---|---|
| 0482475 | 10/1991 | European Pat. Off. . |
| 0603125 | 12/1993 | European Pat. Off. . |
| 0615009 | 2/1994 | European Pat. Off. . |
| 04-240225 | 1/1993 | Japan . |

*Primary Examiner*—Michael A. Neas

*Attorney, Agent, or Firm*—Diller, Ramik & Wight, PC

[57] ABSTRACT

A method for automatically replacing laps in a combing machine, comprising clamping the depleting lap portion, preparing it and retaining its terminal edge fringe, loading the new lap, preparing its initial edge fringe, superposing the edge fringes and joining them pneumatically, then restarting combing.

16 Claims, 8 Drawing Sheets

1
1'
2
3
4
5
8
9
20
21
22
23
24
26
27
28
29
31
32
L

DEVICE AND METHOD FOR AUTOMATICALLY REPLACING THE FEED LAP PACKAGES AND FOR PREPARING AND JOINING THE RELATIVE EDGES IN A COMBING MACHINE

BACKGROUND OF THE INVENTION

This invention relates to fibre combing, an operation in which the fibrous material is fed in the form of a thin-layer blanket, known as a lap, rolled into a package of roll shape and formed by combining and drafting a plurality of fibre slivers originating from carding, and is processed with intermittent motion and rigorous synchronism by a series of mutually cooperating members, such as feed rollers, gripper surfaces, combs formed from circular sectors, etc. For more information on combing devices and their operation, reference should be made to EP 573,121 in the name of the present applicant.

In machines of the most recent design, this process is conducted at a rate of 250–400 beats per minute, and is performed on the edge of the lap which is presented to the comb, ie the fringe. The combing operation is performed on fibres intended for high-value articles, its purpose being to give them those characteristics which carding is not able to give. Its basic purpose is to improve fibre parallelism by avoiding so-called fluctuating fibres, to eliminate a certain quantity of short fibers, and finally to remove impurities and trash. Basically, combing consists of selectively transferring combed long fibre tufts drawn from the feed lap to the product lap, while eliminating trash, which is removed, and the short fibres, which represent a by-product usable for articles of lesser value. Combing machines generally consist of six-eight combing stations or "heads", and more generally of the order of magnitude of ten heads per machine. The product laps from the machine combing stations are then combined to form the product web of combed fibres, which are cleaner, more regular and stronger. Combing machines are generally provided with drives and controls common to the various stations, which are jointly started and halted. This latter occurs in particular when the feed lap package is depleted and has to be replaced with a new package. As already stated, these packages are in the form of a roll having a length of the order of 300 mm and a diameter of the order of 500 mm, in which the lap is wound on a cylindrical tube forming its core. When the feed to one of the stations terminates, all the feed laps in all the stations are generally replaced, even if their set length has not yet been consumed. This operation consists of removing the lap tubes together with any remaining wound lap, replacing them with new lap packages, and preparing the initial edge of the new lap to enable it to be effectively and reliably joined to the tail edge of the preceding lap, which is re-fed to the members of the combing station.

SUMMARY OF THE INVENTION

In particular, the present invention relates to said feed lap replacement operation in a combing machine, and provides a device and method for carrying out all the steps of the replacement operation described in the preceding paragraph without the aid of operators.

BRIEF DESCRIPTION OF THE DRAWINGS

The characteristics and advantages of the present invention will be more apparent from the description of a typical embodiment thereof illustrated in FIGS. 1 to 7 by way of non-limiting example, which show a side view of one of the constituent combing stations of the machine, and illustrate the various steps in the lap replacement operation.

DESCRIPTION OF THE PREFERRED EMBODIMENTS

Figure 1:
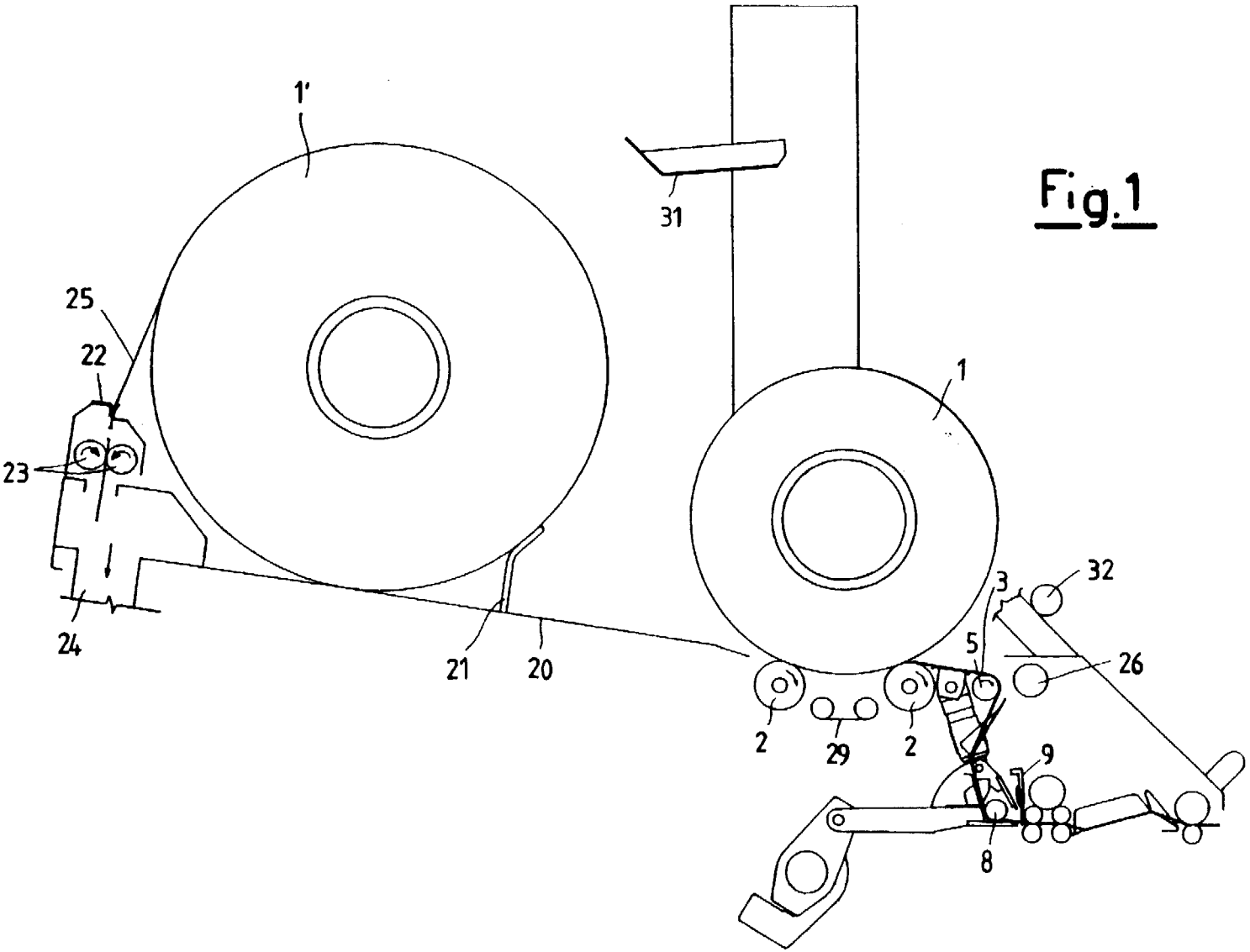

FIG. 1 shows on its right side a combing station in normal operation. The unwinding lap 1 is located in its working position by simply resting on the unwinding rollers 2 which rotate clockwise to cause the lap roll 1 resting on them to rotate anticlockwise. The edge 3 of the unwound lap passes firstly onto the flat ledge 4 for edge resting, positioning and joining - described in detail in relation to the successive steps of the method - and then, by the action of the motorized drive roller 5, passes to the adjustable lap guide blade 6 located to the front right of the lap, to be dragged by the feed roller and enter the actual combing stage.

Figure 1A:
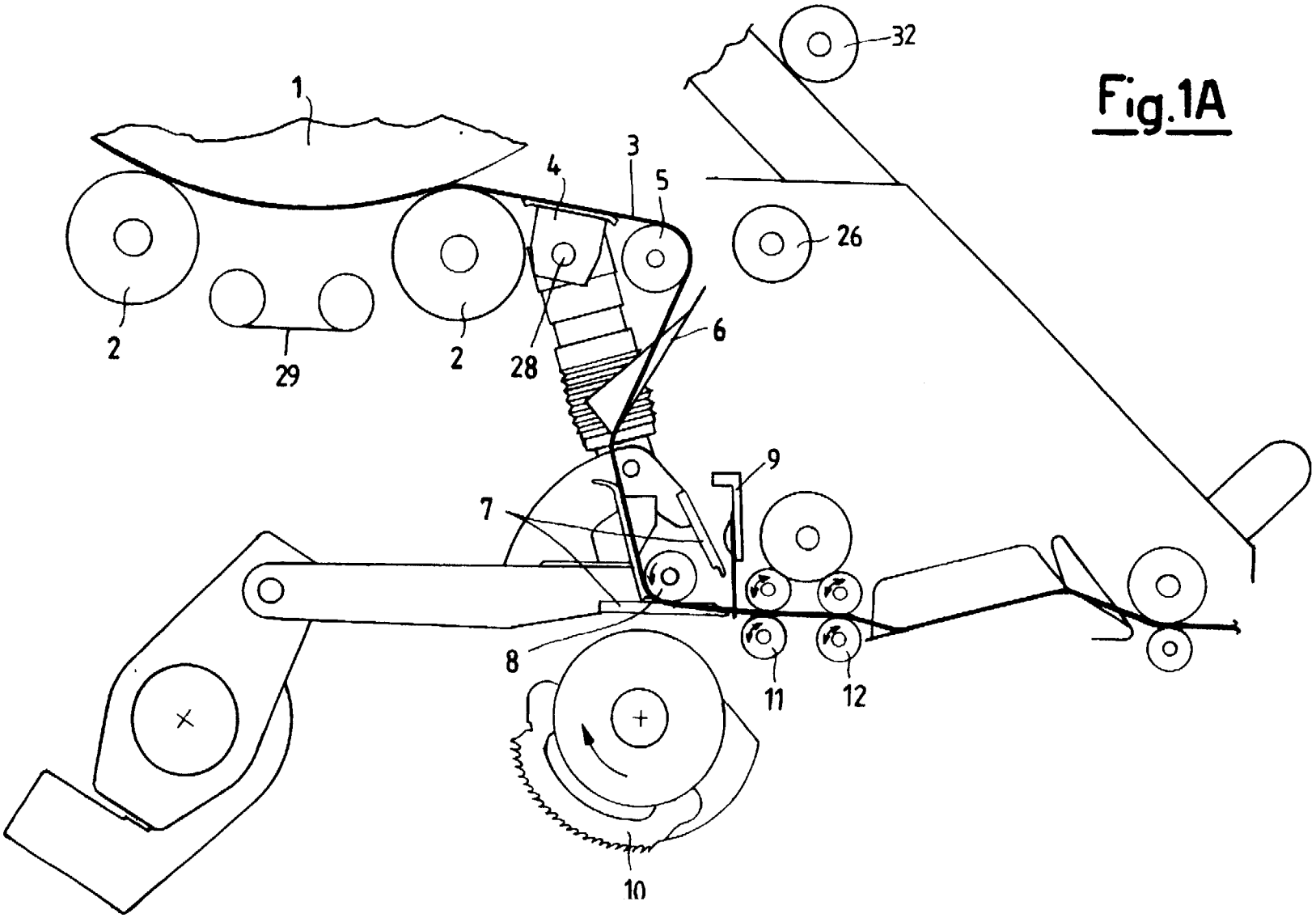

This latter operation does not strictly concern the present invention, its members being shown only schematically in the detailed view of FIG. 1A, in which:

- 7 indicates the gripper unit which moves and grips alternately,
- 8 indicates the lap feed roller,
- 9 indicates the straight comb which cooperates with the rotary comb,
- 10 indicates the rotary comb with its circular sector provided with points,
- 11 and 12 indicate the grabbing rollers which cause the combed web to advance and recede to gradually take up the tufts processed by the combs.

Figure 3:
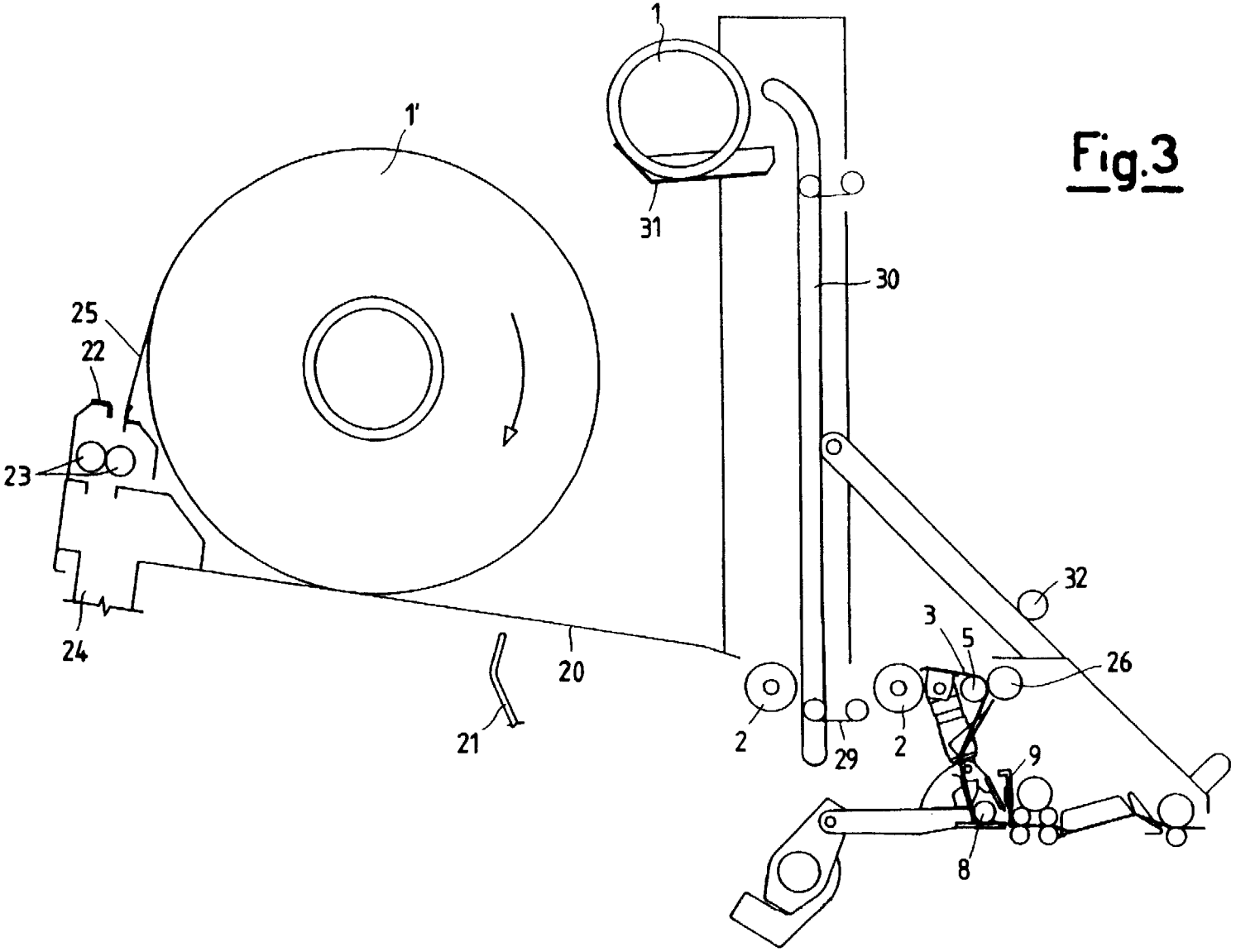

During the processing of the lap 1, a reserve lap 1' is brought to the combing station to replace the lap 1 in its winding position when this latter lap is depleted or when its replacement is ordered. This reserve lap 1' is located on a chute 20 slightly inclined towards the unwinding position and provided with lateral guides, not shown in the figure, the lap being retained resting on a stop arm 21 which is able to assume two alternate positions, namely a raised position to retain the lap 1', as indicated in FIG. 1, or a lowered position which releases the lap 1', as indicated in FIG. 3. The replacement laps can be advantageously transported by automated means, for example by the transportation system described in EP-A-312,503 in the name of the present applicant, which is able to operate both with complete laps and with empty tubes.

The initial edge of the reserve lap 1' must be prepared before the replacement. It is prepared by inserting it both into the gripper 22 and into the pair of stretching rollers 23, which are both closed after this insertion, after which said stretching rollers are briefly operated. The edge is prepared by stretch-breaking within the length between said two members. Downstream of the pair of rollers 23 there is a suction duct 24 which draws off the portion removed from the lap. The edge 25 of the new lap 1' is thus prepared.

The unwinding of the lap 1 resting on its rollers 2 proceeds to the end. It can be seen that this method of operation enables the lap to be unwound at constant linear speed as the diameter of the lap roll varies, this gradually increasing its rotational speed in proportion to the reduction in its diameter. The progressive depletion of the lap and the length unwound are measured by a totalizing revolution counter applied to the rollers 2 and connected to the machine control unit.

Figure 2:
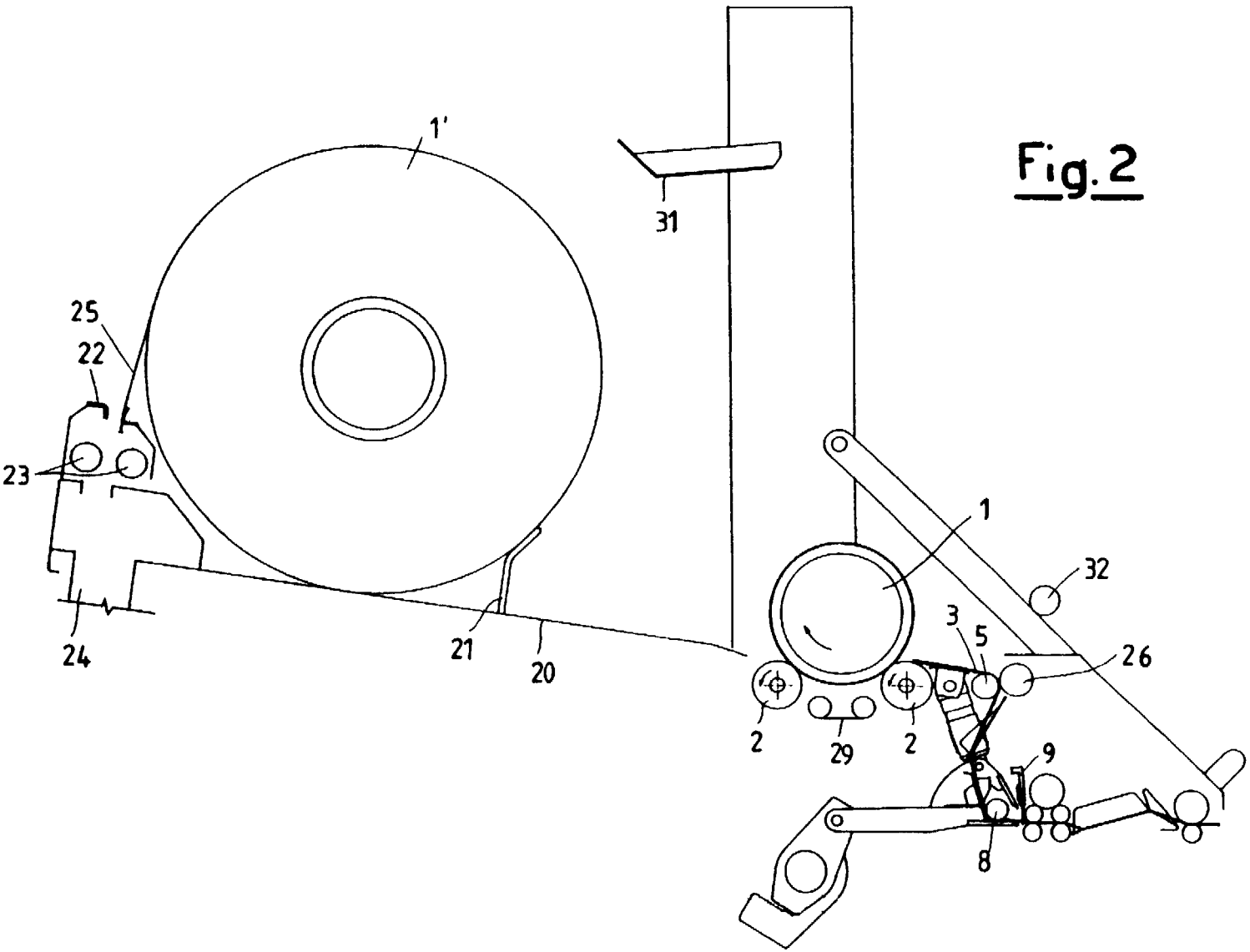

When a first set length is reached in one of the machine combing heads, the combing machine control unit causes it to run at reduced speed. When a second set length is reached the machine is halted, as are the members downstream of the flat resting ledge 4. preparation for lap change is shown in FIGS. 2 and 3. The gripper 22 and the rollers 23 are again opened to release the initial edge 25 of the new lap with its prepared fringe. The backing roller 26 is brought up to the drive roller 5 to grip the portion 3 of the depleting lap 1 and clamp it. This portion is now wound with the final winding revolutions of the lap 1 about its tube and is rested on the unwinding rollers 2. These rollers are then disconnected from their normal clockwise drive for unwinding the lap and are instead connected to a different anticlockwise drive. The rollers 2 are then operated to rewind the edge portion 3 back on its tube. Said edge portion is retained by the contacting pair of rollers 5 and 26 and is torn off in the vicinity of the right roller 2 where it has its point of least resistance. Slits 27 are provided in the flat resting ledge 4 and are connected to a suction system by a duct 28. According to an important characteristic of the present invention, said suction system is able to apply suction at different levels of intensity. During lap change a moderate suction is maintained, sufficient to reliably retain the fringe of the terminal edge of the lap 1 on said ledge 4, for example a suction of 10–20 mm of water column.

With reference to the situation shown in FIG. 3, the elevator fork 29 is now raised to move the residue of the lap 1 with its tube to the unloading position. The elevator 29 moves vertically along a guide 30 which is slightly curved at its upper end to move the residual lap to an automatic transport station 31, for example of the type already mentioned. The tube is then freed from the residual lap and reused in the lap preparation station. The fork 29 travels along its guide in the reverse direction to return to its lower rest position.

Figure 4:
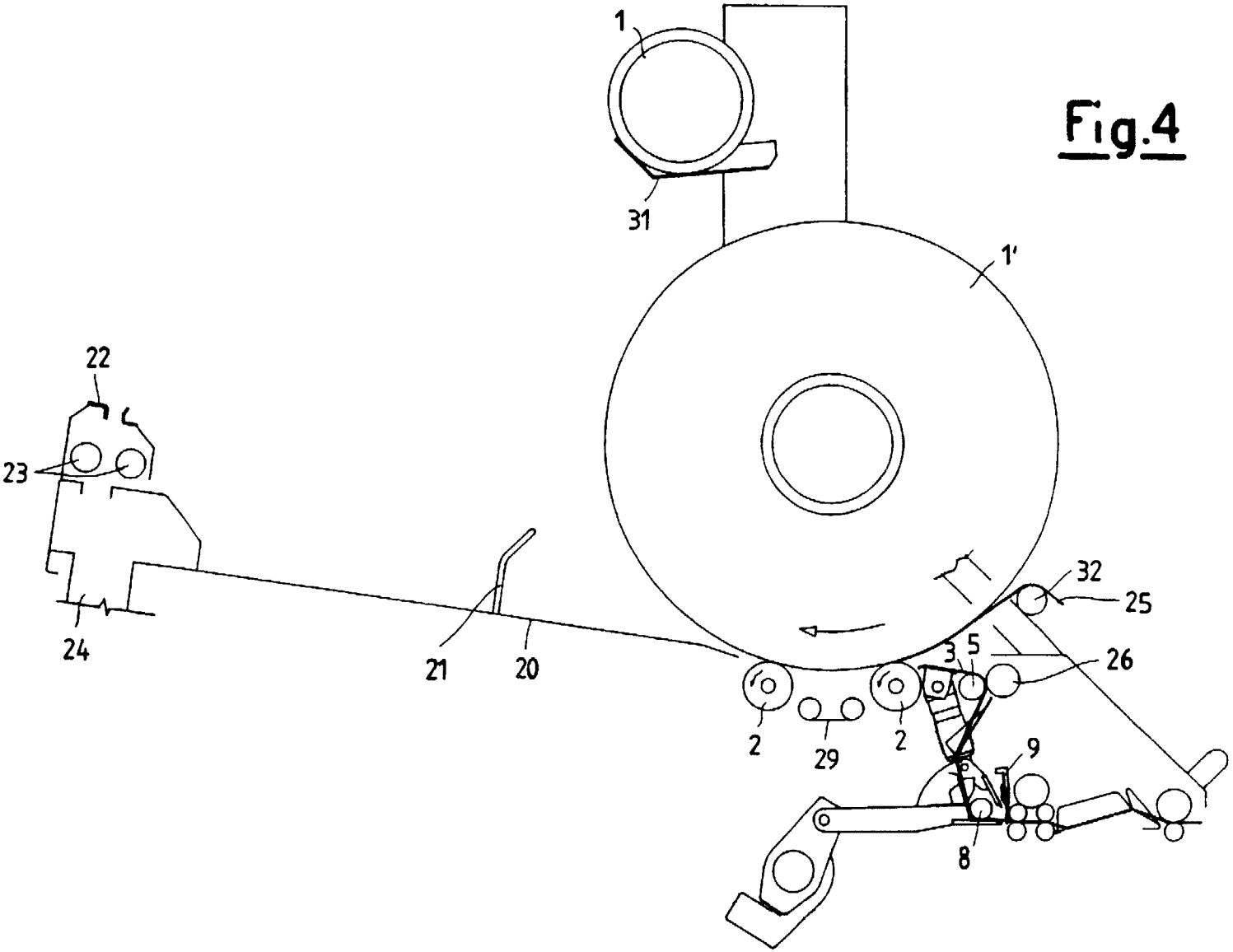

The stop arm 21 is moved into its lowered position to release the lap 1', which rolls towards the right to assume the configuration shown in FIG. 4. The rolling motion is slightly braked by the lateral guides, not shown, of the inclined surface 20, which enable the new lap 1' to reach and halt in a position resting on the unwinding rollers 2. In any eventuality, the downstream bar 32 acts as a safety stop.

Figures 5, 5A:
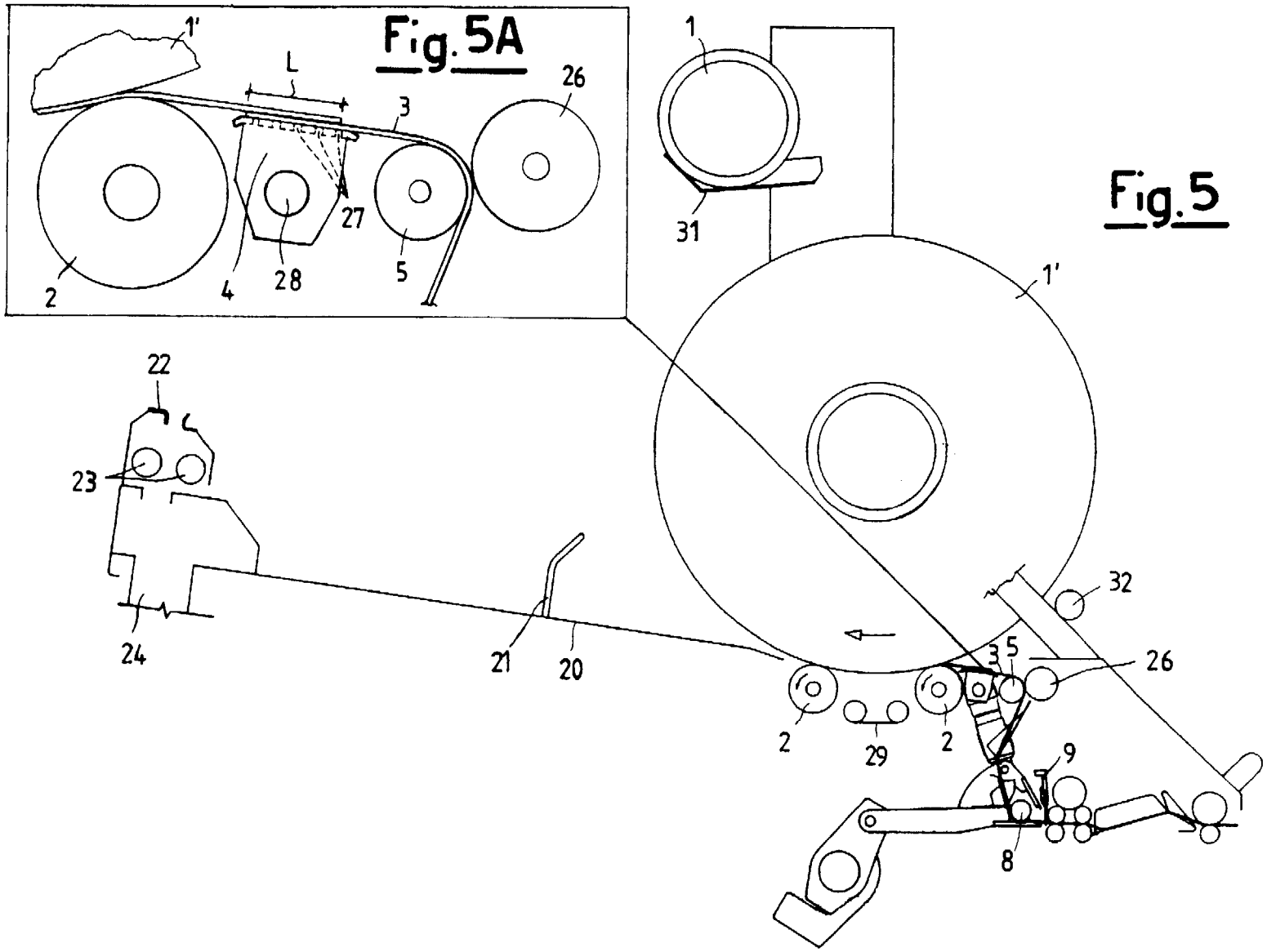

As a result of this rolling, the initial edge 25 of the new lap 1' deposits on and straddles the bar 32, which acts as a receiver for this edge and extends along the entire face of the machine. As in the case of the ledge 4, the bar 32 comprises one or more longitudinal slits connected to a suction system (for simplicity not shown in the figure) by which, during the changing of the lap, sufficient suction is applied to retain the initial edge fringe of the lap 1' and prevent it falling uncontrolledly off the bar. As shown in FIG. 5, the rollers 2 are driven in an anticlockwise direction to rewind the edge 25 back on its tube, so making the edge 25 withdraw from the bar 32 and allowing it to deposit on the ledge 4, on which it is retained by the moderate suction action already described.

During this, and in accordance with an important characteristic of the method of the present invention, the rotation of the rollers 2 is carefully controlled such that the length L by which the end edge of the preceding lap 1 and the initial edge of the new lap 1' are superposed is between 30 and 70 mm and preferably between 40 and 60 mm along their entire width. After said superposing of the two edges, the suction through the duct 28 is raised to its highest value for a time of the order of a few seconds, to achieve pneumatic joining. For example, the suction is raised to 30–40 mm water column for a time of 5–15 seconds. In this respect, this strong air flow drawn through the slits 27 tangles the fibres of the two edge fringes together, to create a continuity which is weak, but is sufficient for resuming the process.

Figure 6:
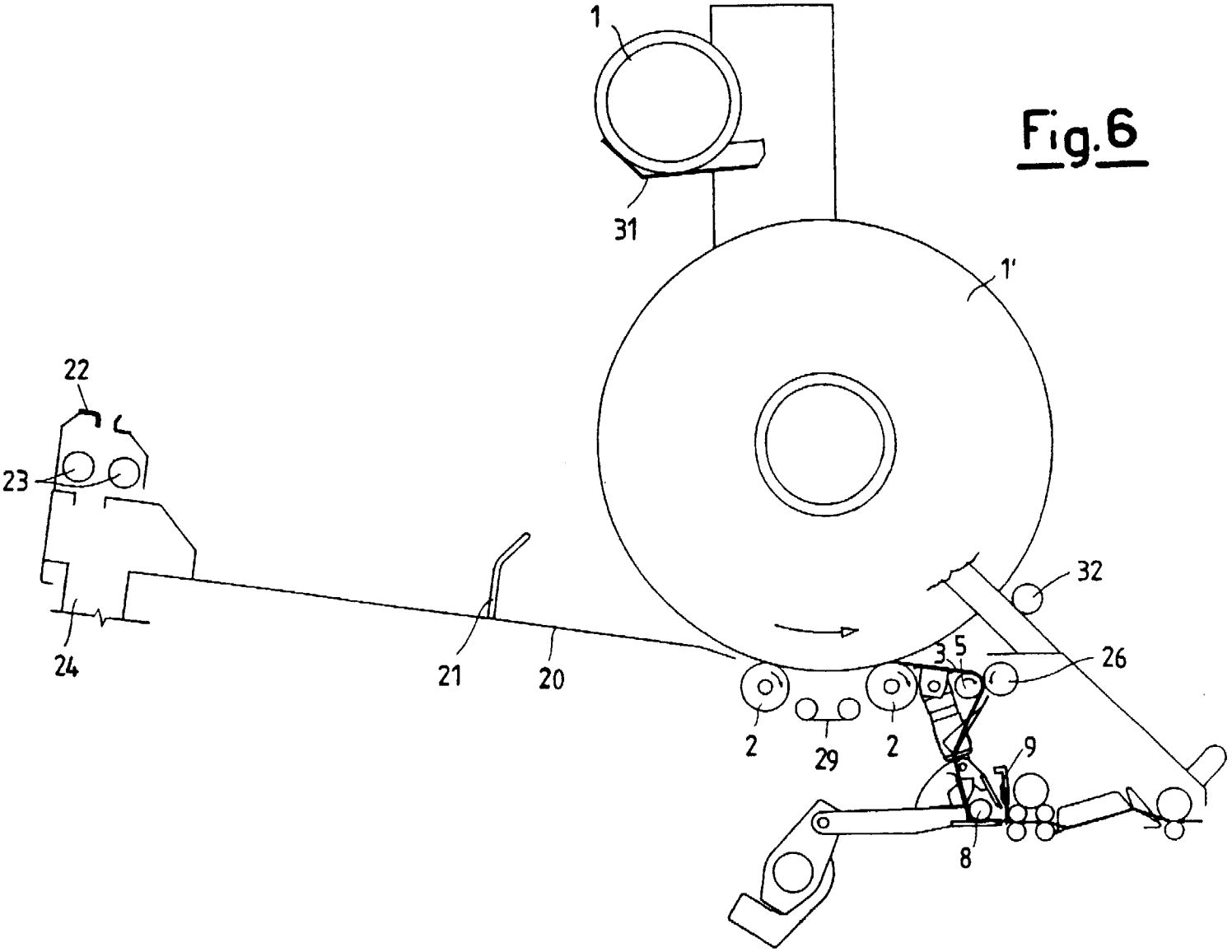

The machine is now ready for the restart, shown in FIG. 6. The unwinding rollers 2 are reconnected to their normal clockwise drive for unwinding the lap 1'. The combing station is restarted at low speed, maintaining the backing roller 26 still pressed against the drive roller 5. The passage of the joined edges through said rollers further increases the cohesion between their fringes. The adjustable guide blade 6 facilitates the passage and conveying of the two layers, compacted but still very delicate, as far as the lap feed roller 8 and enables the new portion 3 to pass through the combing members without problems. The blade 6 is also very useful in guiding the lap feed during the normal combing, in that its protection and guiding effect prevents wavy movements deriving from the pulsation-type retraction of the combing members.

Figure 7:
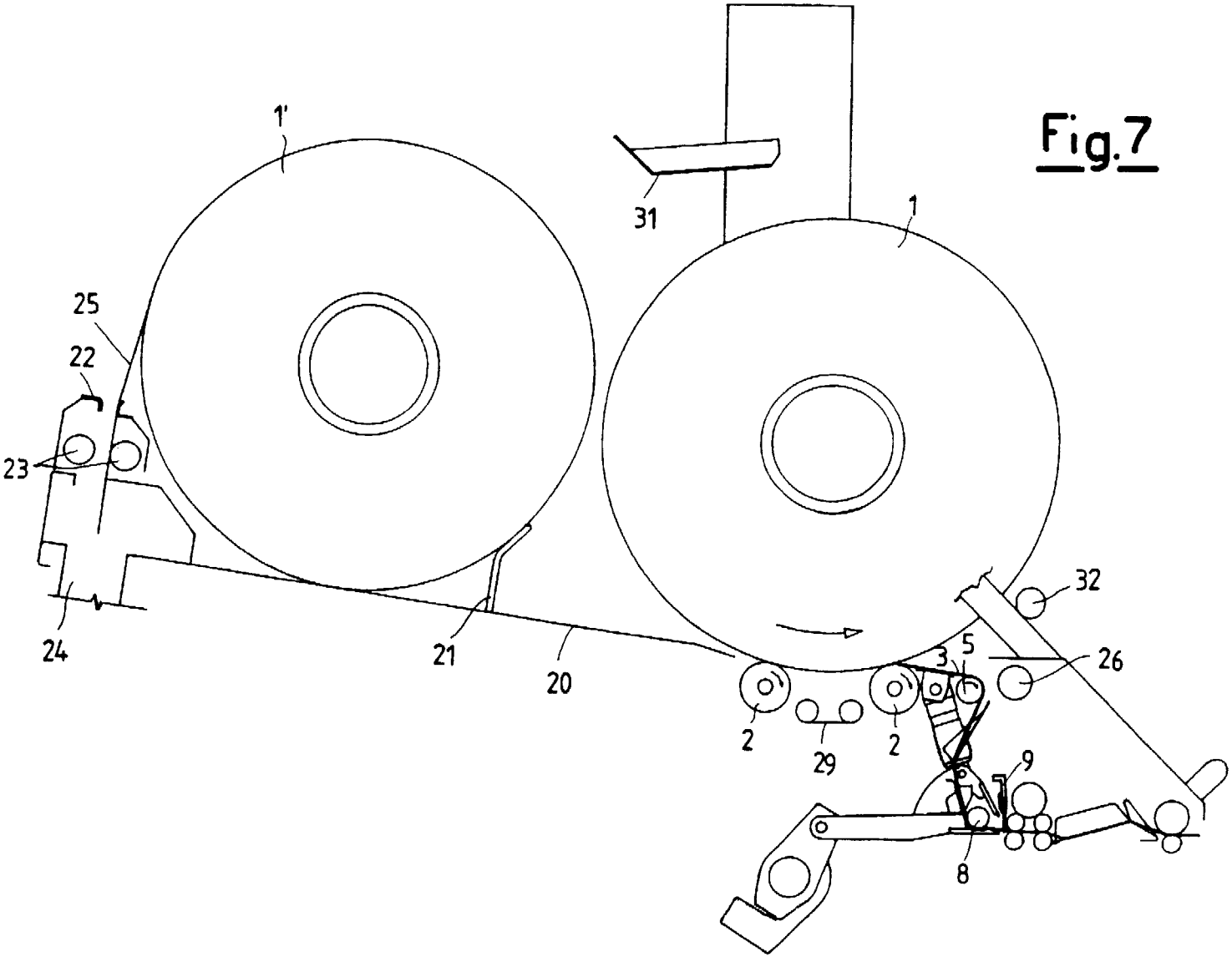

The configuration of FIG. 7 corresponds to the normal combing rate, which is restored when the joined portion has passed beyond the combing members and has been combined with the product of the other machine combing stations, the various joined portions hence being offset and practically no longer distinguishable. When the machine is in this state, the backing roller 26 is in its withdrawn rest position, the unwinding rollers and the other members operate at their normal working speed, and a new reserve lap 1' is put in position. It must then be prepared by the procedure illustrated in FIG. 1, the members for preparing the edge 25 being already in their open waiting position.

Although a preferred embodiment of the invention has been specifically illustrated and described herein, it is to be understood that minor variations may be made in the apparatus without departing from the spirit and scope of the invention, as defined the appended claims.

We claim :

1. A method of automatically replacing a depleting lap with a new lap in a combing machine and joining lap edge portions thereof comprising the steps of clamping a trailing edge portion (3) of a depleting lap (1), changing rollers (2) from a normal drive direction unwinding the depleting lap (1) to another drive direction rewinding the depleting lap, operating the rollers (2) to rewind the trailing edge portion (3) of the depleting lap (1) so that it stretch-breaks in the vicinity of one of the rollers (2) and retaining an edge fringe of the depleting lap (1) upon a resting ledge (4) by suction, unloading the depleting lap (1), loading a new lap (1') having a leading edge portion (25) resting on the rollers (2) and straddling a bar (32), operating the rollers (2) to rewind the leading edge portion (25) of the new lap (1' ) to withdraw the leading edge (25) of the new lap (1' ) from the bar (32) and position the leading edge (25) of the new lap (1' ) on the ledge (4) in a superposing length (L) upon the trailing edge portion (3) of the depleting lap (1), pneumatically joining the superposed edge portions (25,3) at the resting ledge (4), changing the drive of the rollers (2) to their normal unwinding direction, driving the rollers (2) at low speed and subsequently returning to normal speed, providing a new reserve lap (1), and preparing a leading edge (25) of the new reserve lap (1' ) by stretch-breaking the new reserve lap leading edge (25) between a gripper (22) and a pair of rollers (23).

2. The method as defined in claim 1 wherein the superposing length (L) is between 30 and 70 mm.

3. The method as defined in claim 1 including the step of performing the slow speed restarting by utilizing a backing roll (26) and a drive roll (5) between which is driven the superposing length (L).

4. The method as defined in claim 1 wherein the return to normal speed is effected upon the superposing length (L) after having been driven beyond combing members.

5. Apparatus for automatically replacing a depleting lap with a new lap in a combing machine and joining lap edge portions thereof comprising means (5, 26) for clamping a trailing edge portion (3) of a depleting lap (1), means for changing rollers (2) from a normal drive direction unwinding the depleting lap (1) to another drive direction rewinding the depleting lap, means for operating the rollers (2) to rewind the trailing edge portion (3) of the depleting lap (1) so that it stretch-breaks in the vicinity of one of the rollers (2) and retaining an edge fringe of the depleting lap (1) upon a resting ledge (4) by suction, means (29–31) for unloading the depleting lap (1), means for loading a new lap (1') having a leading edge portion (25) resting on the rollers (2) and straddling a bar (32), said rollers operating means operating the rollers (2) to rewind the leading edge portion (25) of the new lap (1') to withdraw the leading edge (25) of the new lap (1') from the bar (32) and position the leading edge (25) of the new lap (1') on the ledge (4) in a superposing length (L) upon the trailing edge portion (3) of the depleting lap (1), means (27, 28) for pneumatically joining the superposed edge portions (25,3) at the resting ledge (4), said rollers changing means changing the drive of the rollers (2) to their normal unwinding direction, driving the rollers (2) at low speed and subsequently returning to normal speed, and means (22, 23, 23) for preparing a leading edge (25) of the new reserve lap (1') by stretch-breaking the new reserve lap leading edge (25).

6. The apparatus as defined in claim 5 including lap guide means (6) downstream of said resting ledge (4) for guiding each lap edge portion toward a lap feed roller (8).

7. The apparatus as defined in claim 5 wherein said resting ledge (4) includes a plurality of slits (27) therein connected to a suction source.

8. The apparatus as defined in claim 5 wherein said resting ledge (4) includes a plurality of slits (27) therein connected to a suction source, and means for varying the intensity of the suction drawn through said slits (27).

9. The apparatus as defined in claim 5 wherein said depleting lap unloading means (29–31) includes elevator means (29) for lifting a depleted lap, and guide means (30) for guiding vertical upward movement of the elevator means (29).

10. The apparatus as defined in claim 5 wherein said bar (32) includes means for applying suction thereto.

11. The apparatus as defined in claim 6 wherein said depleting lap unloading means (29–31) includes elevator means (29) for lifting a depleted lap, and guide means (30) for guiding vertical upward movement of the elevator means (29).

12. The apparatus as defined in claim 6 wherein said bar (32) includes means for applying suction thereto.

13. The apparatus as defined in claim 6 wherein said depleting lap unloading means (29–31) includes elevator means (29) for lifting a depleted lap, and guide means (30) for guiding vertical upward movement of the elevator means (29).

14. The apparatus as defined in claim 7 wherein said bar (32) includes means for applying suction thereto.

15. The apparatus as defined in claim 8 wherein said depleting lap unloading means (29–31) includes elevator means (29) for lifting a depleted lap, and guide means (30) for guiding vertical upward movement of the elevator means (29).

16. The apparatus as defined in claim 8 wherein said bar (32) includes means for applying suction thereto.

* * * * *